US005466555A

United States Patent [19]

Taguchi et al.

[11] Patent Number: 5,466,555

[45] Date of Patent: Nov. 14, 1995

[54] RELEASING COMPOSITION AND BINDER RESIN COMPOSITION FOR ELECTROPHOTOGRAPHIC TONER, AND TONER CONTAINING THE SAME

[75] Inventors: Takayuki Taguchi, Shiga; Kenichi Hasegawa, Kyoto; Sohkichi Baba, Osaka; Yoshitsugu Takai, Kyoto, all of Japan

[73] Assignee: Sanyo Chemical Industries, Ltd., Kyoto, Japan

[21] Appl. No.: 272,822

[22] Filed: Jul. 11, 1994

[30] Foreign Application Priority Data

Apr. 13, 1994 [JP] Japan ..... 6-100646

[51] Int. Cl.[6] ..... G03G 9/087

[52] U.S. Cl. ..... 430/110; 430/137

[58] Field of Search ..... 430/109, 110, 430/137

[56] References Cited

U.S. PATENT DOCUMENTS

| | | | |
|---|---|---|---|
| 5,116,713 | 5/1992 | Uchida et al. | 430/110 |
| 5,185,405 | 2/1993 | Nishida | 526/232 |
| 5,238,767 | 8/1993 | Horiie | 430/110 |

FOREIGN PATENT DOCUMENTS 0421416 4/1991 European Pat. Off. .

OTHER PUBLICATIONS

Patent Abstracts Of Japan, vol. 10, No. 132 (P–456), May 16, 1986 & JP–A–60 254 149, Dec. 14, 1985.

Database WPI, Derwent Publications Ltd., AN 87–245442 & JP–A–62 166358, Jul. 22, 1987.

Database WPI, Derwent Publications Ltd., AN 91–122662, JP–A–03 063659, Mar. 19, 1991 & Corr. US 5,238,767.

Patent Abstracts Of Japan, vol. 17, No. 184 (P–1519), Apr. 9, 1993; Database WPI, Derwent Publication Ltd., AN 93–011853 & JP–A–04 337737, Nov. 25, 1992.

*Primary Examiner*—John Goodrow

*Attorney, Agent, or Firm*—Oblon, Spivak, McClelland, Maier & Neustadt

[57] ABSTRACT

A releasing composition for an electrophotographic toner, which comprises 60~99.5% by weight of a low molecular weight polypropylene (A), and 0.5~40% by weight of at least one modified polyolefin (B) selected from the group consisting of (B1) a modified polypropylene comprising a low molecular weight polypropylene (a1) having a melt viscosity at 160° C. higher than that of said polypropylene (A), modified with an ethylenically unsaturated carboxylic acid or an anhydride thereof (b1), and (B2) a modified polyethylene comprising a low molecular weight polyethylene (a2) having a melt viscosity of 10~8,000 cps at 140° C., modified with an ethylenically unsaturated carboxylic acid or an anhydride thereof (b2). A toner prepared from a combination of the releasing composition and a thermoplastic binder resin exhibits improved flowability without reducing the offset temperature of the toner.

17 Claims, No Drawings

RELEASING COMPOSITION AND BINDER RESIN COMPOSITION FOR ELECTROPHOTOGRAPHIC TONER, AND TONER CONTAINING THE SAME

BACKGROUND OF THE INVENTION

1. Field of the Invention

The present invention relates to a releasing composition suitable for electrophotographic toners (hereinafter referred to as toner). More particularly, it relates to a releasing composition for toners, particularly suitable for those used in copy machines or printers of the heat fixation type.

2. Description of the Background

Toners, in heat fixation methods, are fixed on a substrate with a heated roller. In these methods, it is desired that the minimum temperature for fixing (hereinafter referred to as MF) is low and the hot offset temperature (the temperature causing offset to the heated roller) (hereinafter referred to as HO) is high. In order to meet these two requirements, it has been proposed in the past to add a releasing agent such as low molecular weight polypropylene to the toners during the preparation to attain an elevated HO. In these techniques, there are drawbacks, one of which is that a releasing agent such as a low molecular weight polypropylene results in poor toner flowability (hereinafter referred to as TF), and that sufficiently high HO is not always obtained. In order to remedy these drawbacks, research has been conducted which has resulted in the proposal to modify the toner with a carboxylic acid or anhydride thereof. Such modified low molecular weight polypropylenes, however, are not put to practical use because the HO may be reduced, though reduction of TF can be suppressed.

SUMMARY OF THE INVENTION

Accordingly, one object of the present invention is to provide a releasing composition capable of providing improved TF.

Another object of the present invention is to provide a releasing composition capable of providing high HO together with improved TF.

Still another object of the present invention is to provide such a toner binder composition capable of providing high HO without reducing TF.

Yet another object of the present invention is to provide a toner binder composition, which can reduce filming or the adherence of toner onto carrier particles.

Briefly, these and other objects of the present invention as hereinafter will become more readily apparent can be attained by a releasing composition suitable for electrophotographic toners, which comprises (A) a low molecular weight polypropylene, and (B) a modified polyolefin selected from the group consisting of (B1) a modified polypropylene comprising a low molecular weight polypropylene (a1) having a higher melt viscosity at 160° C. than said polypropylene (A), modified with an acidic monomer (b1), and (B2) a modified polyethylene comprising a low molecular weight polyethylene (a2) having a melt viscosity of 10~8,000 cps at 140° C., modified with an acidic monomer (b2).

DETAILED DESCRIPTION OF THE PREFERRED EMBODIMENTS (A) Low Molecular Weight Polypropylene Suitable polypropylenes include propylene homopolymers, and copolymers of propylene with up to 25%, preferably up to 20%, more preferably up to 10% of one or more other monomers copolymerizable therewith, for example, ethylene, and olefins containing 4~8 or more carbon atoms such as butene and octene (% throughout the specification represents % by weight, unless otherwise specified.) Copolymers containing less than 75% propylene units may result in lower HO.

The melt viscosity at 160° C. of said polypropylene resin (A) is usually 10~3,000 cps (centipoises), preferably 15~2,000 cps. Polypropylenes of melt viscosity higher than 3,000 cps result in poor hot offset effects when used in toners. In case of melt viscosities lower than 10 cps, flowability of toners becomes poor. Melt viscosity at 160° C. is measured with a Brookfield rotational viscometer, under conditions in accordance with JIS-K1557-1970, except the measuring temperature. The temperature of the sample to be measured can be adjusted with an oil bath equipped with a temperature regulator.

Among the polypropylenes, preferred are the thermally degraded products of high molecular weight polypropylene resins. Thermal degradation can be accomplished, for example, by passing a high molecular weight polypropylene resin through reaction vessel, such as a tubular reactor, which is capable of applying heat homogeneously, at a temperature of 300°~450° C. over 0.5~10 hours. The melt viscosity of thermally degraded products can be controlled by the degradation temperature and the degradation period. When the temperature is less than 300° C., a longer period of time is required to attain low melt viscosity; while it is difficult to control the melt viscosity because of too rapid degradation at a temperature exceeding 450° C.

(B) Modified Polyolefin (B1) Modified Polypropylene a) Base Polypropylene (a1)

Suitable low molecular weight polypropylenes (a1), which constitute said modified polypropylene (B1) in this invention, include the same ones as mentioned above which may be the same or different as (A), except that (a1) has a melt viscosity at 160° C. higher than that of (A). The preferred ratio of the melt viscosity at 160° C. of said polypropylene (a1) to the melt viscosity at 160° C. of said (A) is not more than 500/1, more preferably not more than 50/1, particularly not more than 5/1, and at least 1.1/1.

The melt viscosity at 160° C. of said polypropylene (a1) is usually higher than 10 cps and not more than 5,000 cps, preferably 15~3,000 cps. When the melt viscosity is higher than 5,000 cps, the hot offset of the toners become poor. Suitable polypropylenes (a1) include, for example, thermally degraded polypropylenes, unmodified or modified with one or more monomers other than acidic monomers; and oxidates of these modified or unmodified, thermally degraded polypropylenes.

Suitable thermally degraded polypropylenes include those obtained by thermal degradation of high molecular weight polypropylene resins, usually having a melt index of 0.1~150 g/10 min. or more, preferably 1~100 g/10 min., as measured in accordance with JIS K6758. Such high molecular weight polypropylene resins are inclusive of propylene homopolymers, and copolymers of propylene with one or more other monomers copolymerizable therewith, for example, ethylene, and olefins containing 4~8 or more carbon atoms such as butene and octene; as well as propylene (co)polymers modified with one or more monomers other than acidic monomers. Examples of suitable monomers, usable for modification of polypropylenes, before or after thermal degradation include styrenic monomers, such as styrene, α-methylstyrene p-methylstyrene and p-methoxystyrene; esters such as alkyl ($C_{1-18}$) esters of ethylenically unsaturated carboxylic acids such as (meth)acrylic, maleic and itaconic acids, for instance, methyl, ethyl and butyl (meth)acrylates, and mono- or di-methyl, ethyl and butyl maleate; ethylenically unsaturated nitriles such as (meth)acrylonitriles; ethylenically unsaturated organosilane compounds and ethylenically unsaturated organofluorine compounds, as mentioned in U.S. Pat. No. 5,238,767; and mixtures of two or more of these monomers.

Thermal degradation can be done in the same manner as described in (A) above.

Modification may be carried out in the presence or absence of peroxide catalyst.

Oxidates of these modified or unmodified thermally degraded polypropylenes can be produced by partially oxidizing such polypropylenes with oxygen or oxygen-containing gas (air), or with ozone-containing oxygen or ozone-containing gas (air). The resulting oxidates have an acid value of usually at most 80, preferably at most 50.

The content of propylene units of polypropylene (a1) is generally at least 75%, preferably at least 80%, more preferably at least 90%. Copolymers containing less than 75% propylene units may result in toners of lower HO.

Among these polypropylenes (a1), preferred are thermally degraded polypropylenes.

b) Acidic Monomer (b1)

Suitable acidic monomers (b1), for modification of polypropylene (a1), include ethylenically unsaturated carboxylic acids and/or anhydrides thereof, for example, (meth-)acrylic acids including acrylic acid and/or methacrylic acid; (similar expressions are used hereinafter), maleic acid, fumaric acid and itaconic acid; anhydrides, such as maleic, itaconic, citraconic, allylsuccinic and nadic anhydrides; and mixtures of two or more of these monomers. Preferred monomers are (meth)acrylic acid, maleic acid and anhydrides thereof, particularly maleic acid and anhydride thereof.

The content of acidic monomer (b1), constituting modified polypropylene (B1), is generally 0.~50%, preferably 0.2~40%, more preferably 0.5~30%, based on the weight of (a1). Contents of monomer (b1) larger than 50% result in a modified polypropylene which is too hygroscopic, which may make image concentration unstable when used in toners. When (b1) is less than 0.1%, the effect of improving TF is sufficient.

c) Preparation of Modified Polypropylene (B1)

Modified polypropylenes (B1) can be produced by carrying out grafting or addition of one or more monomers comprising the acidic monomer (b1) onto polypropylene (a1) in the presense of or in the absence of peroxide catalyst.

In addition to (b1), up to 30%, preferably up to 20%, based on the weight of (a1) of one or more other monomers, as mentioned above such as styrenic monomers, alkyl (meth)acrylates, alkyl maleates; unsaturated nitriles, unsaturated organosilane and unsaturated organofluorine compounds, may be employed.

Modification is generally carried out within an atmosphere of an inert gas such as nitrogen. The reaction may be carried out at a temperature of usually between the melting point of polyolefin and 300° C. , preferably 140°~250° C., for 1~20 hours. Suitable peroxide catalysts, optionally used in the reaction, include, for example, benzoyl peroxide, lauroyl peroxide, di-t-butyl peroxide, t-butylcumyl peroxide, dicumyl peroxide, t-butylperoxybenzoate, 1,1-bis(t-butylperoxy)-3,3,5-trimethylcyclohexane, and the like.

d) Modified Polypropylene (B1)

Modified polypropylene (B1) usually has an acid number of 0.5~100, preferably 1~40, more preferably 1~20. Products having an acid number less than 0.5 provide toners of poor TF, while ones having an acid number higher than 100 may lower the HO of toners.

Modified polypropylene (B1) Generally has a number-average molecular weight ($\overline{Mn}$) of usually 1,000~20,000, preferably, 1,500~10,000, more preferably 2,000~8,000.

(B2) Modified Polyethylene a) Base Polyethylene (a2)

Low molecular weight polyethylenes (a2), constituting modified polyethylene (B2) of this invention, are low molecular weight polyethylenes having a melt viscosity of 10~8,000 cps, preferably 15~5,000 cps at 140° C., ranging from low density to high density.

Suitable low molecular weight polyethylenes (a2) include, for example, polyethylenes prepared by oligomerization; thermally degraded polyethylenes, unmodified or modified with one or more monomers other than acidic monomers; and oxidates of these modified or unmodified, thermally degraded polyethylenes.

Suitable thermally degraded polyethylenes include polyethylenes prepared by thermal degradation of high molecular weight polyethylene resins, usually having a melt flow rate (MFR) of 0.1~300 or more, preferably 1~250, as measured in accordance with JIS K6760 (at 90° C. and 2.16 kgf load). Such high molecular weight polyethylene resins include ethylene homopolymers, and copolymers of ethylene with one or more other monomers copolymerizable therewith, for example, olefins containing 3~12 or more carbon atoms such as propylene, 1-butene, 4-methyl-1-pentene, 1-pentene, 1-octene, 1-decene and 1-dodecene; as well as ethylene (co)polymers modified with one or more monomers other than acidic monomers. Examples of suitable monomers, usable for modification of polyethylenes before or after thermal degradation, include the same ones as mentioned above such as styrenic monomers, alkyl (meth)acrylates, alkyl maleate, unsaturated nitriles, unsaturated organosilanes and unsaturated organofluorine compounds.

Thermal degradation of polyethylene resins can be accomplished in the same manner as that of polypropylene resins described in (A) above, except that the temperature may be 250°~450° C. Modification and oxidation (production of oxidates) may be carried out in the same manner as polypropylenes.

The content of ethylene units of these polyethylenes is generally at least 75%, preferably at least 80%, more preferably at least 90%. Copolymers containing less than 75% g ethylene units may result in toners of lower HO.

Low molecular weight polyethylenes (a2), such as thermally degraded ones, generally have a $\overline{Mn}$ of 800~20,000, preferably 1,000~10,000, as measured by GPC (gel permeation chromatography). Sufficient TF improving effects are not attained, when $\overline{Mn}$ is less than 800. Polyethylenes having a $\overline{Mn}$ higher than 20,000 have a tendency to reduce HO.

The softening point of (a2) is usually 70°~200° C. preferably 90°~80° C., which can be measured according to the ring and ball method of JIS K2207. Sufficient improvement in TF is not attained, when the softening point is less than 70° C. MF improving effects become insufficient in the case of a softening point exceeding 200° C.

The melt viscosity of (a2) is usually 10~8,000 cps, preferably 15~5,000 cps at 40° C. The flowability of toners becomes poor at melt viscosities lower than 10 cps. When the melt viscosity exceeds 8,000 cps, there is a tendency to reduce HO.

Among low molecular weight polyethylenes (a1), preferred are thermally degraded polyethylenes.

Suitable thermally degraded polyethylenes include polyethylenes containing usually 1~10, preferably 2~7 terminal double bonds per 1,000 carbon atoms. Polyethylenes containing less than 1 terminal double bond per 1,000 carbon atoms cannot be reacted with sufficient amount of acidic monomer and provide toners of poor TF.

b) Acidic Monomer (b2)

Suitable acidic monomers (b2), for modification of polyethylene (a2), include monomers the same which are as the abovementioned acidic monomers (b1). Among these, preferred are (meth)acrylic acid, maleic acid and anhydrides thereof, particularly maleic acid and anhydride thereof.

The content of acidic monomer (b2), constituting modified polyethylene (B2), is generally 0.1~50%, preferably 0.2~40%, more preferably 0.5~30%, based on the weight of (a2). Use of (b2) larger than 50% results in a polyethylene which is too hygroscopic, which may make image concentration unstable when used in toners. When (b2) is less than 0.1%, sufficient improvement in TF is not attained.

c) Preparation of Modified Polyethylene (B2)

Modified polyethylenes (B2) can be produced by carrying out grafting or addition of one or more monomers comprising acidic monomer (b2) onto polyethylene (a2) in the presence of or in the absence of peroxide catalyst, in the same manner that polypropylene (B1) is modified. Similarly, up to 30% of one or more other monomers may be used in addition to (b2).

d) Modified Polyethylene (B2)

Modified polyethylene (B2) usually has an acid number of 0.5~100, preferably 1~50, more preferably 1~20. Products having an acid number less than 0.5 provide toners of poor TF, while polyethylenes having an acid number higher than 100 may lower the HO of toners.

Modified polyethylene (B2) generally has a $\overline{Mn}$ of usually 1,000~20,000, preferably 1,500~10,000, more preferably 2,000~8,000. Products having $\overline{Mn}$ less than 1,000 provide toners of poor TF, while polyethylene having a $\overline{Mn}$ higher than 10,000 may lower the HO of toners.

(I) Releasing composition

In the releasing composition of the present invention, comprising a low molecular weight polypropylene (A) and a modified polyolefin (B) [(B1) and/or (B2)], the content of (A) is generally 60~99.5%, preferably 70~99%, more preferably 80~98%, and the content of (B) is usually 0.5~40%, preferably 1~30%, more preferably 2~20%. The use of (B) in amounts less than 0.5% results in a poor TF improving of the toner, while (B) in an amount exceeding 60% may cause reduction of HO.

(II) Binder Resin

Suitable binders include thermoplastic resins, for example, polyester resins, styrenic and/or acrylic resin, epoxy resins, poloyurethane resins, and the like.

Suitable polyesters include, for example, polycondensation products of a polycarboxylic acid component with a polyol component, and ring-opened polymers of a lactone. Examples of suitable polyols include aliphatic diols such as ethylene glycol, 1,2- and 1,3-propanediol, 1,4-butanediol, 1,6-hexanediol and neopentyl glycol and diethylene glycol, and alcoholates such as sodium alcoholate of these diols; cycloaliphatic diols, such as cyclohexylene glycol, cyclohexane dimethanol and hydrogenated bisphenol A; aromatic diols such as the bisphenols which include bisphenol A, bisphenol S and bisphenol F and hydroquinone, and esters and alcoholates of these phenols such as diacetylbisphenol A and bisphenol A disodium alcoholate; aliphatic polyols containing 3~8 hydroxyl groups such as trimethylolpropane, glycerin, pentaerythritol and the like; as well as alkylene oxide ($C_2$~$C_4$) (hereinafter referred to as AO) adducts of these diols and polyols such as ethylene oxide (hereinafter referred to as EO) and/or propylene oxide (hereinafter referred to as PO) adducts of bisphenol A, and EO and/or PO adducts of bisphenol F; polyalkylene glycols such as polyethylene glycol, polypropylene glycol and polytetramethyleneether glycol. Among these, preferred are AO adducts of aromatic diols, aliphatic diols and combinations of them, particularly AO adducts of aromatic diols especially PO adducts of bisphenol A. Illustrative of suitable polycarboxylic acid components include $C_2$~$C_{30}$ aliphatic dicarboxylic acids such as malonic, succinic, adipic, sebacic and dodecane dicarboxylic acids, and esters and halides of these acids such as dimethyl adipate and adipic dichloride; aromatic dicarboxylic acids such as terephthalic, isophthalic, phthalic and naphthalene dicarboxylic acids, esters and halides of these acids such as dimethyl terephthalate and terephthalic dichloride; and tribasic or higher carboxylic acids such as trimellitic acids. Among these, preferred are aromatic dicarboxylic acid and combinations thereof with aliphatic dicarboxylic acid. Suitable lactones include caprolactone. Polyesters may be hydroxyl-terminated or carboxyl-terminated. Illustrative of suitable polyester resins are polyesters of terephthalic acid with PO adducts of bisphenol A.

Suitable styrenic and/or acrylic resins include, for example, (co)polymers of one or more styrenic monomers such as styrene; and styrene homologues or substituted styrenes, including alkyl($C_1$~$C_8$)styrenes such as α-methylstyrene, o-, m-and p-methylstyrenes, p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, aryl-substituted styrenes such as p-phenylstyrene, alkoxy-substituted styrenes such as p-methoxystyrene, halogen-substituted styrenes such as p-chlorostyrene, 3,4-dichlorostyrene; and mixtures of two or more of them such as mixtures of styrene with one or more styrene homologues; copolymers of (1) one or more these styrenic monomers with (2) one or more (meth)acrylic monomers, for example, esters of (meth)acrylic acids, for example alkyl($C_1$~$C_8$) (meth)acrylates, such as methyl, ethyl, n- and i-butyl, propyl, n-octyl, 2-ethylhexyl, dodecyl lauryl and stearyl (meth)acrylates; aryl (meth)acrylates such as phenyl (meth)acrylates; hydroxyl-containing (meth)acrylates such as hydroxyethyl (meth)acrylates; amino-containing (meth)acrylates, such as dimethylaminoethyl, diethylaminoethyl and morpholinoethyl (meth)acrylates; epoxy-containing (meth)acrylates such as Glycidyl (meth)acrylates; (meth)acrylic acids, and derivatives thereof such as (meth)acrylonitriles and (meth)acrylamides; and the like and/or (3) one or more other monomers for example vinyl esters such as vinyl acetate and vinyl propionate; aliphatic hydrocarbon monomers such as α-olefins and butadiene; vinyl ethers, such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidine; unsaturated carboxylic acids such as maleic and itaconic acids or derivatives thereof such as anhydrides and esters; and the like, with or without (4) one or more one polyfunctional monomers containing at least two polymerizable double bonds, for example aromatic di- or poly-vinyl compounds, such as divinylbenzene and divinyltoluene; di- or poly-(meth)acrylates of polyols such as ethylene glycol di(meth)acrylates, 1,6-hexanediol di (meth)acrylates, di (meth)acrylates of EO adducts of bisphenol A; and so on; and (co)polymers of one or more (meth)acrylic monomers (2), with or without one or more monomers (3) and/or (4). Among monomers (1) , preferred is styrene. Among monomers (2) , preferred are alkyl (meth)acrylates and (meth)acrylic acids, particularly methyl, ethyl, butyl and 2-ethylhexyl (meth)acrylates. Among monomers (3), preferred are vinyl esters and aliphatic hydrocarbon monomers, particularly vinyl acetate and butadiene. Among monomers (4), preferred are divinyl benzene and 1,6-hexanediol diacrylate. In styrenic and/or acrylic resins, the contents of these monomers (1), (2), (3) and (4) can be varied widely, but the usual ranges are as follows : [(1)+(2)] 70~100%. preferably 80~100%; (3) 0~30%, preferably 0~20%; and (4) 0~0.1 mole %, preferably at 0~0.05 mole %, based on the total monomers. Among these styrenic and/or acrylic resins, preferred are styrenic resins and styrene-acrylic resins, containing (1) 50~100%, preferably 60~98%; and (2) 0~50 %, preferably 5~40%. Styrenic and/or acrylic resins may be produced using any known polymerization techniques such as solution, suspension, bulk and emulsion polymerizations, and combinations of them such as solution polymerization followed by suspension or bulk polymerization, or suspension polymerization followed by solution or bulk polymerization. Polymerization can be carried out in the presence of one or more polymerization initiators, for example, azo compounds, such as azobis-iso-butyronitrile, azobis-iso-valeronitrile and the like; peroxides such as those mentioned above for modification; and so on. The amount of polymerization initiators can vary widely, but is generally 0.02~1.0%, preferably 0.03~0.8%, based on the total weight of the monomers. Polymerization is generally carried out within an atmosphere of inert gas such as nitrogen, at a temperature of usually 50°~250° C., preferably 70°~230° C. The reaction period, which may be varied with other conditions, is usually 1~50 hours, preferably 2~15 hours.

Illustrative examples of styrenic polymers are styrene/(meth)acrylate copolymers such as styrene/butyl acrylate copolymers and styrene/butyl acrylate/divinylbenzene terpolymers (a molar ratio of styrene/butyl acrylate= about ⅔), and styrene/butadiene copolymers.

Suitable epoxy resins and polyurethanes are inclusive of those described in U.S. Pat. No. 5,238,767.

Among these binder resins, preferred are styrenic resins, particularly styrene/(meth)acrylic copolymers and especially polyester resins.

The molecular weight of binder resins may vary widely; but preferred are those having a $\overline{Mn}$ of about 2,000~ about 50,000 or higher, preferably about 3,000~ about 30,000. Weight-average molecular weight ($\overline{Mw}$ of binder resins is usually about 100,000~ about 2,000,000, preferably about 150,000 -about 1,500,000. When $\overline{Mw}$ is less than 100,000, it is difficult to obtain sufficient HO; and $\overline{Mw}$ higher than 2,000,000 results in too high MF. Molecular weight distribution $\overline{Mw}/\overline{Mn}$] of binder resins is generally at least about 20, preferably at least about 30. A $\overline{Mw}/\overline{Mn}$ less than 20 results in poor balance of HO and MF. The glass transition temperature (Tg) of binder resins is generally about 40~ about 80° C., preferably about 45~ about 70° C. Resins of Tg less than 40° C. provide toners of poor shelf stability; and when the Tg is higher than 80° C., the MF becomes too high to be used practically as toners.

(III) Resin Composition for Toner

The resin resin composition for an electrophotographic toner comprises (I) a releasing composition, comprising a low molecular weight polypropylene (A) and a modified polyolefin (B) [(B1) and/or (B2)], and (II) a binder resin.

The amount of the releasing composition (I) [(A)+(B)] is generally 0.5~10%, preferably 1~5%, based on the total weight of (I) and (II), for use in the preparation of toners. Masterbatches containing (I) in a larger amount, for instance, 10~15%, preferably 20~40%, may be prepared, followed by adding the rest of (II) in producing toner.

In producing resin compositions, the components (A), (B) and (II) can be added in any order. (A) and (B) may blended beforehand, or added separately to (II). Binder resins may be added beforehand to the releasing composition to obtain a resin composition for toners, or may be added together with the releasing composition during preparation of toners to obtain toners. The releasing composition can be mixed with the binder resin by any known method. The releasing composition may be added during polymerization (preparation of binder resin), or may be blended with the binder resin after polymerization, using a mixer. Preferably that the releasing composition is homogeneously distributed in the resin composition, to obtain excellent release effects.

Resin compositions of the invention may contain optionally one or more colorants and various additives to form toners.

Examples of suitable colorants and other additives include inorganic and organic pigments such as carbon black, iron black, benzidine yellow, quinacridone pigments, rhodamine B, phthalocyanine pigments and the like; carrier particles, for example, magnetic powders, such as powders of ferromagnetic metals and compounds such as iron, cobalt, nickel, magnetite, hematite, ferrite and the like; glass beads and the like; charge controllers such as nigrosine, quaternary ammonium salts and metal complexes lubricants such as polytetrafluoroethylene, fatty acids and metal salts or amides thereof, plasticisers, hydrophobic colloidal silica powders, antioxidants such as hindered phenols, sulfur compounds and phosphorus compounds, as described in U.S. Pat. No. 5,238,767, and so on.

In electrophotographic toners, the contents of these components can be varied widely. In general, the ranges may be approximately as follows:

colorant: usually 1~30%, preferably 3~20% magnetic powder: usually 0~60%, preferably 0~50% charge controller: usually 0~10%, preferably 0.5~5% other additives: usually 0~10%, preferably 0~5%

An electrphotographic toner can be prepared by any known method, for instance, 1) by dry blending these toner components and then melt kneading the mixture, followed by crushing, and then finely pulverizing with a grinder such as a jet grinder, thereafter classifying the pulverized material to obtain particles usually 2~20μ diameter or 2) by suspension-polymerizing monomers (precursors for the binder component) in the presence of the other toner components to obtain particles usually 2~20μ diameter.

The toner can be optionally mixed with one or more carrier particles such as iron powder, glass beads, nickel powder and ferrite, and used as a developer for electrical latent images. Besides, hydrophobic colloidal silica powder may be used to improve TF.

The toner can be fixed on substrates such as paper, polyester film and the like to be used as recording materials. Fixation may be accomplished by any known fixation means, for example, by heat roll fixation of copy machines, such as heat-fixation type copyers or printers.

Having generally described the invention, a more complete understanding can be obtained by reference to certain specific examples, which are included for purposes of illustration only and not intended to be limiting unless otherwise specified.

In the followings, the term "parts" represent parts by weight.

In the following examples, the $\overline{Mn}$ and $\overline{Mw}$ of polyolefins and modified polyolefins, were measured by GPC under following conditions:

Equipment: 150CV, produced by Waters.

Columns: Shodex KF-80M, 2 columns, and Shodex AT-800P, 1 column.

Temperature: 135° C.

Sample solution: 0.3% o-dichlorobenzene solution.

Amount of solution: 100 microliters.

Detector: Refractometer.

Binder resins used in the following examples are as follows: (1) Binder (i): A thermoplastic styrene-acrylic resin, having a Tg of 53° C., $\overline{Mn}$ of 11,000 and a $\overline{Mw}$ of 70,000, prepared by thermally polymerizing 660 parts of styrene and 340 parts of butyl acrylate at 130°~180° C. without using any solvent and any polymerization initiator, followed by removing volatile matter such as unreacted monomers under reduced pressure of not more than 5 mmHg at 180° C. The $\overline{Mn}$ and $\overline{Mw}$ of Binder (i) were measured by GPC under the following conditions:

Equipment: HCL-802A, produced by Toyo Soda Manuf.

Columns: TSK gel GMH6, 2 columns, produced by Toyo Soda Manuf.

Temperature: 25° C.;

Sample solution: 0.5% THF solution.

Amount of solution: 200 microliters.

Detector: Refractometer.

Calibration curve was prepared using standard polystyrenes.

(2) Binder (ii): a thermoplastic polyester, having a TG of 63° C., an acid number of 45 and a hydroxyl number of 1.5, prepared by polycondensing 302 parts of isophthalic acid with 480 parts of an adduct of 2 moles EO to bisphenol A at 220° C. in the presense of 1.6 parts of dibutyltin oxide.

Preparation of Low Molecular Weight Polypropylenes (A)

EXAMPLE A-1

A high molecular weight polypropylene resin (J130G, produced by Ubekosan; MFR=30) was thermally degraded by introducing the resin continuously into a tubular reaction vessel equipped with a static mixer under heating to 355°~360° C. for 80 minutes to obtain a polypropylene (A-1) having an isotactic content of 96%, $\overline{Mn}$ of 3,000 and a melt viscosity of 70 cps at 160° C.

EXAMPLE A-2

A high molecular weight ethylene-propylene copolymer (J609H, produced by Ubekosan; MFR=9, ethylene content= about 7 mol. %) was thermally degraded in the same manner as Example A-1 to obtain a polypropylene (A-2) having an isotactic content of 90% and a melt viscosity of 72 cps at 160° C.

[Preparation of Modified Polyolefins (B)]

EXAMPLE B1-1

1) Example A-1 was repeated except that the heating period was 50 minutes to obtain a thermally degraded polypropylene (a1-1) having a melt viscosity of 300 cps at 160° C.

2) Then, 400 parts of (a1-1) and 12 parts of maleic anhydride were charged into a reaction vessel, equipped with a nitrogen inlet, a thermometer, a condensor and a stirrer, and heated under stirring within an atmosphere of nitrogen to 195° C. for 10 hours. After the reaction, volatile matter (such as unreacted maleic anhydride) was removed under reduced pressure of 5 mmHg maintaining the temperature to 195° C. for an hour to obtain a modified polypropylene (B1-1) having an acid number of 13 and a melt viscosity of 430 cps at 160° C.

EXAMPLE B1-2

Into an autoclave, were charged 400 parts of (a1-1) and 40 parts of maleic anhydride, and heated under stirring within an atmosphere of nitrogen to 180° C. Then, 100 parts of 2% xylene solution of di-t-butyl peroxide were added thereto continuously dropwise over 4 hours. Then, the product after cooling was removed into a vessel equipped with a thermometer and a stirrer, and volatile matter such as xylene and unreacted maleic anhydride was removed under reduced pressure of not more than 5 mmHg at 195° C. for 2 hours to obtain a modified polypropylene (B1-2) having an acid number of 42 and a melt viscosity of 2200 cps at 160° C.

EXAMPLE B2-1

1) A high molecular weight polyethylene resin (J5019, produced by Ubekosan; MFR=50) was thermally degraded by introducing the resin continuously into a tubular reaction vessel equipped with a static mixer under heating to 300°~305° C. for 50 minutes to obtain a thermally degraded polyethylene (a2-1) having a $\overline{Mn}$ of 3,000 and a melt viscosity of 290 cps at 140° C.

2) Then, 400 parts of (a2-1) and 12 parts of maleic anhydride were charged into a reaction vessel, equipped with a nitrogen inlet, a thermometer, a condensor and a stirrer, and heated under stirring within an atmosphere of nitrogen to 200°~230° C. for 10 hours. After the reaction, volatile matter such as unreacted maleic anhydride was removed under reduced pressure of 5 mmHg while maintaining the temperature to 230° C. for 2 hours to obtain a modified polyethylene (B2-1) having an acid number of 15, $\overline{Mn}$ of 3,200 and a melt viscosity of 500 cps at 140° C.

EXAMPLE B2-2

Into an autoclave, were charged 300 parts of (a2-1), 20 parts of maleic anhydride and 400 parts of xylene. The materials were heated under stirring within an atmosphere of nitrogen to 180° C. Then, 20 parts of 10% xylene solution of di-t-butyl peroxide were added thereto continuously dropwise over 15 minutes. Then, the product after cooling was removed into a vessel equipped with a thermometer and a stirrer, and volatile matter such as xylene and unreacted maleic anhydride was removed under reduced pressure of not more than 5 mmHg at 180° C. for 2 hours to obtain a modified polyethylene (B2-2) having an acid number of 28, $\overline{Mn}$ of 3,100 and a melt viscosity of 3,800 cps at 140° C.

Preparation of Releasers

Examples 1~8 and Comparative Examples 1~4

In accordance with the formulations (parts) written in Table 1, a polypropylene (A) and a modified polyolefin (B) were charged into a vessel equipped with a thermometer and a stirrer, and heated under stirring to 180° C. for an hour to obtain releasing compositions (Releasers R1~R8).

For comparison, releasing compositions (Releasers R9 and R10) containing (A) and (B) in a ratio beyond the scope of the invention were prepared in the same manner. Releasing compositions (Releasers R11 and R12) consisting of (A) or (B) alone are also used for comparison.

TABLE 1

| Example | | Example | | | | | | | | Comparative Example | | | |
|---|---|---|---|---|---|---|---|---|---|---|---|---|---|
| No. | | 1 | 2 | 3 | 4 | 5 | 6 | 7 | 8 | 1 | 2 | 3 | 4 |
| (A) | (A-1) | 480 | 480 | 425 | — | 440 | 440 | 375 | — | 150 | 140 | 500 | — |
| | (A-2) | — | — | — | 480 | — | — | — | 440 | — | — | — | — |
| (B) | (B1-1) | 20 | — | 75 | 20 | — | — | — | — | — | — | — | — |
| | (B1-2) | — | 20 | — | — | — | — | — | — | 350 | — | — | — |
| | (B2-1) | — | — | — | — | 60 | — | 125 | 60 | — | — | — | 500 |
| | (B2-2) | — | — | — | — | — | 60 | — | — | — | 360 | — | — |
| Releaser No. | | R1 | R2 | R3 | R4 | R5 | R6 | R7 | R8 | R9 | R10 | R11 | F12 |

Preparation of Resin Compositions

Example 9

Into a vessel equipped with a thermometer and a stirrer, 450 parts of Binder (i) and 50 parts of Releaser R1 were charged, and heated under stirring to 190° C. for 2 hours to prepare a resin composition (C-1).

Example 10

In the same manner as Example 9, using Releaser R5, a resin composition (C-2) was prepared.

Preparation of Toners and Developers, and Evaluation

Examples I~XII and Comparative Examples I~IV

Using each releaser or resin composition and binder, toners for electrophotography and electrophotographic developers were produced and evaluated as follows:

[1] Preparation of toners In accordance with the formulations (parts) written in Table 2, the ingredients were powder dryblended, and kneaded with a laboplast mill at 140° C. at 30 rpm for 10 minutes, followed by finely pulverizing the kneaded mixture with a jet mill (PJM100, produced by Nippon Pneumatic Mfg. Co.,Ltd.) and then classifying with a dispersion separator (MSD, produced by Nippon Pneumatic Mfg. Co., Ltd.) to cut fine powders of less than 2 microns diameter. To 1000 parts of the resulting powder, 3 parts of a colloidal silica powder (Aerosil R972, produced by Japan Aerosil Co.) were added and homogeneously mixed to obtain a toner.

TABLE 2

| Example | Example | | | | | | | | | | | | Comparative Example | | | |
|---|---|---|---|---|---|---|---|---|---|---|---|---|---|---|---|---|
| No. | I | II | III | IV | V | IV | VII | VIII | IX | X | XI | XII | I | II | III | IV |
| Releaser | R1 | R2 | R3 | R4 | | R1 | R5 | R6 | R7 | R8 | | R5 | R9 | R10 | R11 | R12 |
| | 4 | 4 | 4 | 4 | — | 4 | 4 | 4 | 4 | 4 | — | 4 | 4 | 4 | 4 | 4 |
| Resin | | | | | C1 | | | | | | C2 | | | | | |
| Compn. | — | — | — | — | 40 | — | — | — | — | — | 40 | — | — | — | — | — |
| Binder | (i) | (i) | (i) | (i) | (i) | (ii) | (i) | (i) | (i) | (i) | (i) | (ii) | (i) | (i) | (i) | (i) |
| | 87 | 87 | 87 | 87 | 51 | 87 | 87 | 87 | 87 | 87 | 51 | 87 | 87 | 87 | 87 | 87 |
| CB*1 | 8 | 8 | 8 | 8 | 8 | 8 | 8 | 8 | 8 | 8 | 8 | 8 | 8 | 8 | 8 | 8 |
| CC*2 | 1 | 1 | 1 | 1 | 1 | 1 | 1 | 1 | 1 | 1 | 1 | 1 | 1 | 1 | 1 | 1 |

*1Carbon black, MA-100, produced by Mitsubishi-kasei Co.
*2Charge controller, Spiron black TRH, produced by Hodogaya Chemical Co.

[2] Preparation of developer

To 25 parts of each toner as above, 1000 parts of a iron powder carrier (F-100, produced by Nippon Seihun Co. ) were added and mixed to obtain a developer.

[3] Evaluation

1) HO: using a commercially available electrophotographic copy machine of the heat fixation type, HO (the temperature causing offset to the heated roller) was measured, or occurrence of hot offset at a heat roll temperature of 230° C. was observed with the eyes.

2) Flowability: Flow index (FI) was measured with a powder tester, produced by Hosokawa Micron, Co.

3) Filming to carrier: after mixing developer with a turbula shaker mixer at 100 r.p.m. for 3 hours, the amount of toner adhering on the surface of carrier was observed with a microscope.

4) MF: A commercially available electrophotographic copy machine of the heat fixation type was used MF (the temperature of the heated roller providing a printed image density of the solid part which remained of at least 70% after 5 times reciprocating rubbing of the black solid part of printed image density of 1.2 with a Gakushin fastness tester (rubbed part=paper).

The results were as shown in Table 3.

TABLE 3

| Example No. | | Releaser (Compn.) | HO, °C. | FI | Filming | MF, °C. |
|---|---|---|---|---|---|---|
| Example | I | R1 | ≧240 | ≧80 | little | <130 |
| | II | R2 | ≧240 | ≧80 | little | <130 |
| | III | R3 | ≧240 | ≧80 | little | <130 |
| | IV | R4 | ≧240 | ≧80 | little | <130 |
| | V | R1(C1) | ≧240 | ≧80 | little | <130 |
| | VI | R1 | ≧240 | ≧85 | little | <130 |
| | VII | R5 | ≧240 | ≧80 | little | <130 |
| | VIII | R6 | ≧240 | ≧80 | little | <130 |
| | IX | R7 | ≧240 | ≧80 | little | <130 |
| | X | R8 | ≧240 | ≧80 | little | <130 |
| | XI | R5(C2) | ≧240 | ≧80 | little | <130 |
| | XII | R5 | ≧240 | ≧80 | little | <130 |
| Comparative Example | I | R9 | <220 | ≧85 | little | <130 |
| | II | R10 | <220 | ≧80 | little | <130 |
| | III | R11 | ≧240 | <70 | much | ≧150 |
| | IV | R12 | <220 | ≧80 | little | ≧130 |

Releasing compositions, comprising (A) and (B), according to the present invention, can provide toners having improved anti-hot offset properties without reducing flowability. Besides, the releasing compositions can effectively prevent toner adhesion (filming) towards carrier to attain toners having a low tendency of filming towards carrier. In addition, improved low temperature fixability can be attained.

What is claimed as new and desired to be secured by Letters Patent is:

1. A releasing composition for electrophotographic toner, which comprises 60~99.5% by weight of a low molecular weight polypropylene (A) which has a melt viscosity of 15~2,000 cps at 160° C., and 0.5~40% by weight of at least one modified polyolefin (B), selected from the group consisting of:

(B1) a modified polypropylene, comprising a low molecular weight polypropylene (a1) having a melt viscosity at 160° C. higher than that of said polypropylene (A), modified with an ethylenically unsaturated carboxylic acid or an anhydride thereof (b1), and (B2) a modified polyethylene, comprising a low molecular weight polyethylene (a2) having a melt viscosity of 10~8,000 cps at 140° C., modified with an ethylenically unsaturated carboxylic acid or an anhydride thereof (b2).

2. The composition of claim 1, wherein the ratio of the melt viscosity of at 160° C. of component (a1) to the melt viscosity at 160° C. of component (A) is not more than 500/1.

3. The composition of claim 1, wherein the ratio of the melt viscosity of at 160° C. of component (a1) to the melt viscosity at 160° C. of component (A) is at least 1.1/1 and not more than 500/1.

4. The composition of claim 1, wherein component (b1) is at least one monomer selected from the group consisting of acrylic acid, methacrylic acid, maleic acid and anhydride thereof.

5. The composition of claim 1, wherein component (B) has an acid number of 0.5~100.

6. The composition of claim 1, wherein component (B) has a number-average molecular weight of 1,000~20,000.

7. The composition of claim 1, wherein component (a1) has a melt viscosity of higher than 10 cps and up to 5,000 cps at 160° C.

8. The composition of claim 1, wherein component (A) is a propylene homopolymer, or a copolymer of propylene with up to 20% by weight of at least one other olefin selected from the group consisting of ethylene, butene and octene.

9. The composition of claim 1, wherein component (A) is obtained by thermal degradation of a high molecular weight polypropylene.

10. The composition of claim 1, which comprises 70~99% by weight of component (A), and 1~30% by weight of modified polyolefin (B).

11. A resin composition for electrophotographic toner, which comprises the releasing composition of claim 1 and a thermoplastic binder resin.

12. The composition of claim 11, comprising 0.5~10% by weight of the composition of claim 1, and 90~99.5% by weight of a thermoplastic binder resin.

13. The composition of claim 11, wherein component binder resin is at least one resin selected from the group consisting of a polyester, a styrenic resin, an acrylic resin, a polyolefin resin, a polyurethane and an epoxy resin.

14. The composition of claim 11, wherein component binder resin is a polyester.

15. The composition of claim 14, wherein the polyester is a polycondensate of a polycarboxylic acid with a polyol comprising an oxyalkylene ether of a bisphenol.

16. The composition of claim 11, wherein component binder resin is a copolymer of a styrenic monomer with an acrylic or methacrylic monomer.

17. An electrophotographic toner, which comprises a toner binder resin, a colorant, and a releasing agent, said releasing agent comprising 60~99.5% by weight of a low molecular weight polypropylene (A), which has a melt viscosity of 15~2,000 cps at 160° C., and 0.5~40% by weight of at least one modified polyolefin (B), selected from the group consisting of (B1) a modified polypropylene, comprising a low molecular weight polypropylene (a1) having a melt viscosity at 160° C. higher than that of component polypropylene (A), modified with an ethylenically unsaturated carboxylic acid or an anhydride thereof (b1), and (B2) a modified polyethylene, comprising a low molecular weight polyethylene (a2) having a melt viscosity of 10~8,000 cps at 140° C., modified with ethylenically unsaturated carboxylic acid or an anhydride thereof (b2).

* * * * *

UNITED STATES PATENT AND TRADEMARK OFFICE

CERTIFICATE OF CORRECTION

PATENT NO. : 5,466,555

DATED : November 14, 1995

INVENTOR(S) : Takayuki TAGUCHI, ET AL.

It is certified that error appears in the above-indentified patent and that said Letters Patent is hereby corrected as shown below:

On the title page, Item [30], the Foreign Application Priority Data should be deleted.

Signed and Sealed this

Second Day of April, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,466,555

DATED : November 14, 1995

INVENTOR(S) : Takayuki TAGUCHI ET AL

It is certified that error appears in the above-identified patent and that said Letters Patent is hereby corrected as shown below:

Column 2, line 49, "of said polypropylene" should read -- of polypropylene --.

Column 3, line 5, "α-methylstyrene p-methylstyrene" should read --α-methylstyrene, p-methylstyrene--.

Column 3, line 44, "generally 0.~50%" should read --generally 0.1 ~ 50%--.

Column 4, line 30, "at 90°C." should read --at 190° C.--.

Column 4, line 54, "75% g ethylene" should read --75% ethylene--.

Column 4, line 63, "90° ~ 80° C." should read --90° ~ 180° C.--.

Column 5, line 2, "at 40° C." should read --at 140° C.--.

UNITED STATES PATENT AND TRADEMARK OFFICE

CERTIFICATE OF CORRECTION

PATENT NO. : 5,466,555

DATED : November 14, 1995

INVENTOR(S) : Takayuki TAGUCHI ET AL

It is certified that error appears in the above-identified patent and that said Letters Patent is hereby corrected as shown below:

Column 5, line 16, "monomers the same which are as" should read --monomers which are the same as--.

Column 6, line 50, "($C_1$-$C_8$)" should read --($C_1$-$C_{18}$)--.

Column 7, line 23, "70-100%. preferably" should read --70-100%, preferably--.

Column 7, line 60, "(Mw" should read --(Mw)--.

Column 7, line 65, "$\overline{Mw/Mn}$]" should read --($\overline{Mw/Mn}$)--.

Column 8, line 7, "The resin resin composition" should read --The resin composition--.

Column 8, line 17, "may blended" should read --may be blended--.

Column 8, line 40, "complexes lubricants" should read --complexes; lubricants--.

UNITED STATES PATENT AND TRADEMARK OFFICE

CERTIFICATE OF CORRECTION

PATENT NO. : 5,466,555

DATED : November 14, 1995

INVENTOR(S) : Takayuki TAGUCHI ET AL

It is certified that error appears in the above-identified patent and that said Letters Patent is hereby corrected as shown below:

Column 9, line 11, "followings" should read --following--.

Column 11, Table 1, Comparative Example 4, Releaser No. "F12" should read --R12--.

Column 13, line 28, Table 3, last line, last box, "≧ 130" should read --< 130 --.

Signed and Sealed this

Twentieth Day of August, 1996

*Attest:*

*Attesting Officer*

BRUCE LEHMAN

*Commissioner of Patents and Trademarks*